US011918079B2

(12) United States Patent
Parisotto et al.

(10) Patent No.: US 11,918,079 B2
(45) Date of Patent: Mar. 5, 2024

(54) SKI BOOT

(71) Applicant: CALZATURIFICIO S.C.A.R.P.A. S.P.A., Asolo (IT)

(72) Inventors: Davide Parisotto, Asolo (IT); Elenio Menegon, Asolo (IT)

(73) Assignee: CALZATURIFICIO S.C.A.R.P.A. S.P.A. (IT)

( * ) Notice: Subject to any disclaimer, the term of this patent is extended or adjusted under 35 U.S.C. 154(b) by 0 days.

(21) Appl. No.: 17/698,622

(22) Filed: Mar. 18, 2022

(65) Prior Publication Data

US 2022/0338593 A1 Oct. 27, 2022

(30) Foreign Application Priority Data

Mar. 23, 2021 (IT) ..... 102021000006977
Feb. 22, 2022 (IT) ..... 102022000003257

(51) Int. Cl.
*A43B 5/04* (2006.01)
*A43C 11/14* (2006.01)

(52) U.S. Cl.
CPC ..... *A43B 5/0474* (2013.01); *A43C 11/1493* (2013.01)

(58) Field of Classification Search
CPC ... A43B 5/0474; A43B 5/0476; A43B 5/0452; A43B 5/0435; A43B 5/16; A43B 5/1666; A43C 11/1493; A43C 11/14
See application file for complete search history.

(56) References Cited

U.S. PATENT DOCUMENTS 5,203,098 A * 4/1993 Perrissoud ..... A43B 5/0452 36/118.8
5,394,628 A * 3/1995 DeMarchi ..... A43B 5/0456 36/118.9
6,267,390 B1 7/2001 Maravetz
2004/0143999 A1* 7/2004 Grella ..... A43C 11/146 36/117.1

(Continued)

FOREIGN PATENT DOCUMENTS

EP 0504769 A1 9/1992
EP 3725175 A1 10/2020

(Continued)

OTHER PUBLICATIONS

Definition of "stable" from oed.com (last visited Jun. 2, 2023). (Year: 2023).*

*Primary Examiner* — Patrick J. Lynch
(74) *Attorney, Agent, or Firm* — The Belles Group, P.C.

(57) ABSTRACT

A ski boot including a substantially rigid foot-case adapted to accommodate a user's foot, a substantially rigid cuff adapted to surround a lower part of the user's leg and being pivotally joined to the foot-case so as to be able to rotate about a reference axis substantially perpendicular to a mid-plane of the ski boot and a closing mechanism adapted to selectively close/tighten the on the user's foot. The closing mechanism may include a locking band, which extends transversally to the midplane of the ski boot having a first end firmly fixed to a first lateral side of the foot-case and a manually-operated coupling assembly adapted to connect a the second end of the locking band selectively and alternatively to the foot-case or to the cuff, at a second lateral side of the foot-case opposite to the first lateral side.

16 Claims, 4 Drawing Sheets

(56) References Cited

U.S. PATENT DOCUMENTS

| | | | | |
|---|---|---|---|---|
| 2009/0320327 | A1* | 12/2009 | Perkins | A43B 5/0445<br>36/118.7 |
| 2017/0238650 | A1* | 8/2017 | Battilana | A43B 5/047 |

FOREIGN PATENT DOCUMENTS

| | | | | |
|---|---|---|---|---|
| WO | WO8100507 | A1 | 3/1981 | |
| WO | WO-03073881 | A1 * | 9/2003 | A43B 5/1666 |

* cited by examiner

SKI BOOT

CROSS-REFERENCE TO RELATED APPLICATIONS

This patent application claims priority from Italian patent applications no. 102021000006977 filed on Mar. 23, 2021, and no. 102022000003257 filed on Feb. 22, 2022, the entire disclosure of which is herein incorporated by reference.

TECHNICAL FIELD

The present invention relates to a ski boot.

More specifically, the present invention relates to an mountaineering ski boot, to which the following disclosure will explicitly refer without thereby losing generality.

STATE OF THE PRIOR ART

As is known, mountaineering ski boots currently on the market comprise: a rigid foot-case, which is mainly made of plastic or composite material, is substantially shoe-shaped so as to accommodate/hold the user's foot, and has the lower part specifically structured for being fixed to the back of a downhill ski or the like by means of a suitable mountaineering ski binding device; a rigid cuff, which is mainly made of plastic or composite material, is shaped so as to embrace from behind the lower part of the user's leg, and is hinged to the foot-case so as to be able to rotate about a transversal reference axis, which is substantially perpendicular to the vertical midplane of the ski boot, and also locally substantially coincides with the articulation axis of the ankle; and an internal inner-boot with a soft and thermal-insulating structure, which is inserted in removable manner into the foot-case and the cuff, and is shaped so as to accommodate and protect both the user's foot and the user's leg, approximately up to the height of the calf.

In most of the mountaineering ski boots currently on the market, the upper part of the foot-case is moreover provided with a longitudinal slit which extends in sagittal direction, over the instep and astride of the midplane of the ski boot, and the mountaineering ski boot additionally comprises an oblong and flattened in shape, protective tongue with a semi-rigid structure, which is generally separate and distinct from the foot-case, and is placed resting on the upper part of the foot-case, covering the longitudinal slit.

More specifically, the protective tongue is usually tip-hinged to the upper-front part of the foot-case so as to be able to flip forward and, when it is in abutment onto the upper part of the foot-case, it prevents snow and ice from penetrating inside the ski boot through the longitudinal slit.

The abovementioned mountaineering ski boots are finally provided with a foot-case closing mechanism, and with a cuff closing mechanism, both operated manually.

The foot-case closing mechanism is structured so as to be able to selectively close/tighten the upper part of the foot-case against the user's foot, so as to immobilise the user's foot inside the inner-boot. Whereas, the cuff closing mechanism is structured so as to be able to selectively close/tighten the upper part of the cuff against the user's leg, so as to immobilise the user's leg inside the inner-boot.

In most of the mountaineering ski boots currently on the market, the foot-case closing mechanism consists of one or two lever closing buckles that are arranged on the upper part of the foot-case, across and astride of the tongue, are fixed in rigid manner to the foot-case on opposite sides of the tongue, and are finally capable of pulling one toward the other the two edges of the foot-case flanking the longitudinal slit, so as to tighten the upper part of the foot-case against the user's foot.

Patent application EP3725175 A1, on the other hand, shows a mountaineering ski boot wherein the foot-case closing mechanism comprises: a strip of plastic material with a flexible and inextensible structure, which has the proximal end firmly fixed to the inner side of the foot-case, at the hinge connecting the cuff to the foot-case, and extends obliquely along the inner side up to reach and superimpose the protective tongue, so as to place the distal end of the flexible strip over the tongue, approximately astride of the midplane of the ski boot; a series of fairlead members which are arranged in an alternated manner on opposite sides of the outer longitudinal edge of the protective tongue, and are firmly fixed to the foot-case or to the protective tongue immediately beneath; and a small manually-operated cable-winding winch, which is firmly fixed to the distal end of the strip of plastic material, and is provided with a metal cable that exits the winch, engages in pass-through and free slidable manner the various fairlead members, passing from one side to the other of the outer longitudinal edge of the tongue, and finally has the distal end firmly anchored to the tongue or to the foot-case.

OBJECT OF THE INVENTION

Aim of the present invention is to improve the foot-case closing mechanism described in patent application EP3725175 A1.

In accordance with these aims, according to the present invention there is provided a ski boot comprising: a substantially rigid foot-case, which is adapted to accommodate the user's foot and has the lower part structured to couple with a ski binding device; a substantially rigid cuff, which is adapted to surround the lower part of the user's leg, and is pivotally joined to the foot-case so as to be able to rotate about a transversal axis substantially perpendicular to the midplane of the ski boot; a protective tongue and/or gaiter, that closes the upper part of the foot-case; and foot-case closing means adapted to selectively close/tighten the foot-case on the user's foot;

the ski boot being characterised in that the foot-case closing means comprise: an oblong, transversal locking band with a flexible and substantially inextensible structure, which extends transversally to the midplane of the ski boot, astride of and flush to the protective tongue and/or gaiter, and has a first end fixed/connected to a first lateral side of the foot-case; and a manually-operated coupling assembly, which is adapted to connect the second end of said transversal locking band selectively and alternatively to the foot-case or to the cuff, at a second lateral side of the foot-case opposite to said first lateral side.

Preferably, though not necessarily, the ski boot is furthermore characterised in that the coupling assembly is adapted to tighten and keep tightened the transversal locking band.

Preferably, though not necessarily, the ski boot is furthermore characterised in that the coupling assembly comprises: a first component stably located on the foot-case, along the second lateral side of the foot-case; a second component stably located on the cuff, at/flush to the second lateral side of the foot-case; and a third component, which is stably located on the transversal locking band and is selectively connectable/couplable, on choice and alternatively, to the first or to the second component in a rigid and stable, though easily releasable manner, so as to anchor said locking band on choice and alternatively to the foot-case or to the cuff.

Preferably, though not necessarily, the ski boot is furthermore characterised in that the coupling assembly comprises: a first stationary anchoring element located on the foot-case, along said second lateral side of the foot-case; and a second stationary anchoring element located on the cuff, along said second lateral side of the foot-case; and a manually-operated coupling device, which is firmly and stably fixed on said transversal locking band and is adapted to couple in a rigid and stable, though easily releasable manner, on choice and alternatively to said first or to said second stationary anchoring element.

Preferably, though not necessarily, the ski boot is furthermore characterised in that said coupling device is moreover adapted to tighten the transversal locking band.

Preferably, though not necessarily, the ski boot is furthermore characterised in that the first stationary anchoring element comprises a first rack; wherein the second stationary anchoring element comprises a second rack; and wherein the coupling device comprises a lever closing buckle adapted to couple to any one of said racks.

Preferably, though not necessarily, the ski boot is furthermore characterised in that the transversal locking band is fixed/connected to said first lateral side of the foot-case, at the hinge connecting the cuff to the foot-case.

Preferably, though not necessarily, the ski boot is furthermore characterised in that the transversal locking band comprises: a flexible ribbon-like element arranged astride of and flush to said protective tongue and/or gaiter; a return member firmly fixed to the foot-case and/or on the cuff, along said first lateral side of the foot-case; and a flexible cable which is connected in rigid manner to the flexible ribbon-like element, extends obliquely along said first lateral side of the foot-case, up to reach and engage in slidable manner said return member, and then rises obliquely along said first lateral side of the foot-case, towards the upper part of the foot-case, so as to go beyond the protective tongue and/or gaiter and reach said second lateral side of the foot-case.

Preferably, though not necessarily, the ski boot is furthermore characterised in that the distal end of the flexible cable is anchored in rigid manner to the body of the foot-case or to the body of the protective tongue.

Preferably, though not necessarily, the ski boot is furthermore characterised in that said return member is fixed directly on the hinge connecting the cuff to the foot-case.

Preferably, though not necessarily, the ski boot is furthermore characterised in that said return member is fixed on said first lateral side of the foot-case with the capability of swinging about a reference axis substantially parallel to said transversal axis.

Preferably, though not necessarily, the ski boot is furthermore characterised in that said the foot-case closing means additionally comprise at least one auxiliary fairlead member which is stably located on said second lateral side of the foot-case, close to said protective tongue and/or gaiter, and the flexible cable is adapted to engage in free slidable manner also said auxiliary fairlead member.

Preferably, though not necessarily, the ski boot is furthermore characterised in that said the transversal locking band comprises: a flexible ribbon-like element which is arranged astride of and flush to said protective tongue and/or gaiter, and has the proximal end firmly fixed to the foot-case and/or to the cuff, along said first lateral side of the foot-case.

Preferably, though not necessarily, the ski boot is furthermore characterised in that the proximal end of said flexible ribbon-like element is fixed directly to the hinge connecting the cuff to the foot-case.

Preferably, though not necessarily, the ski boot is furthermore characterised in that the proximal end of said flexible ribbon-like element is fixed on said first lateral side of the foot-case with the capability of swinging about a reference axis substantially parallel to said transversal axis.

Preferably, though not necessarily, the ski boot is furthermore characterised in that said first lateral side of the foot-case is the inner side of the foot-case, and said second lateral side of the foot-case is the outer side of the foot-case.

Preferably, though not necessarily, the ski boot is furthermore characterised in that the protective tongue is separate from the foot-case and has the front end firmly fixed to the upper-front part of the foot-case, with the capability of flipping forward.

Preferably, though not necessarily, the ski boot is furthermore characterised in that a second end of said transversal locking band rests on the protective tongue, and is locally firmly fixed to the same protective tongue in a transversally sliding manner.

Preferably, though not necessarily, the ski boot is furthermore characterised in that the second end of said transversal locking band is arranged resting on the protective tongue, and is provided with an oblong slot which extends transversally to the same locking band, and is engaged in free slidable manner by a protruding pin that juts out cantilevered from said protective tongue; said oblong slot being substantially rectilinear and/or parallel to said direction.

BRIEF DESCRIPTION OF THE DRAWINGS

The present invention will now be described with reference to the accompanying drawings, which illustrate a non-limiting example embodiment thereof, wherein:

FIG. 6 is a perspective view of the lower part of a second alternative embodiment of the ski boot illustrated in the preceding figures, with parts removed for clarity's sake; whereas

PREFERRED EMBODIMENT OF THE INVENTION

Figure 1:
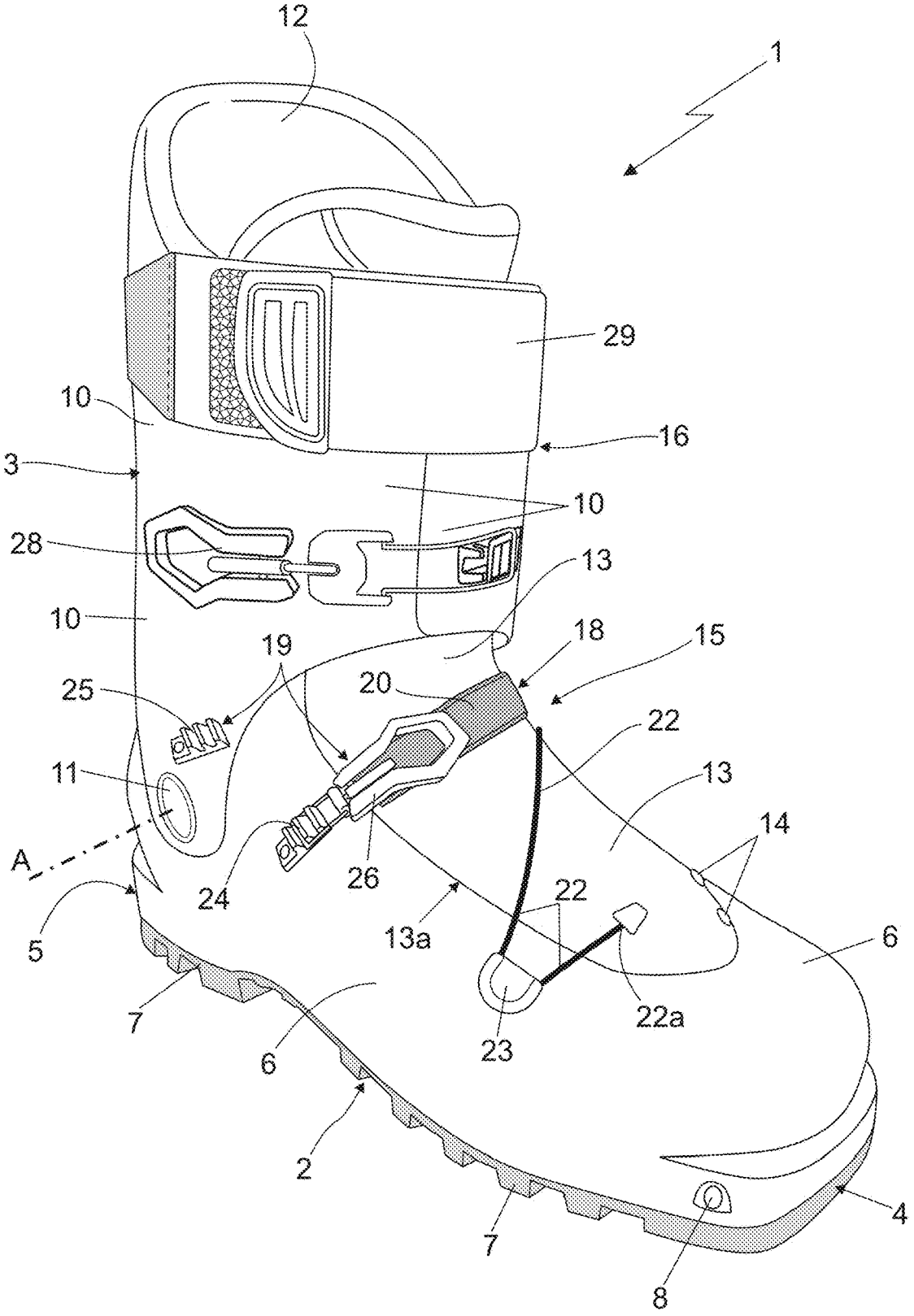
FIG. 1 is a perspective view of a ski boot realized according to the teachings of the present invention, with parts removed for clarity's sake.
Figure 2:
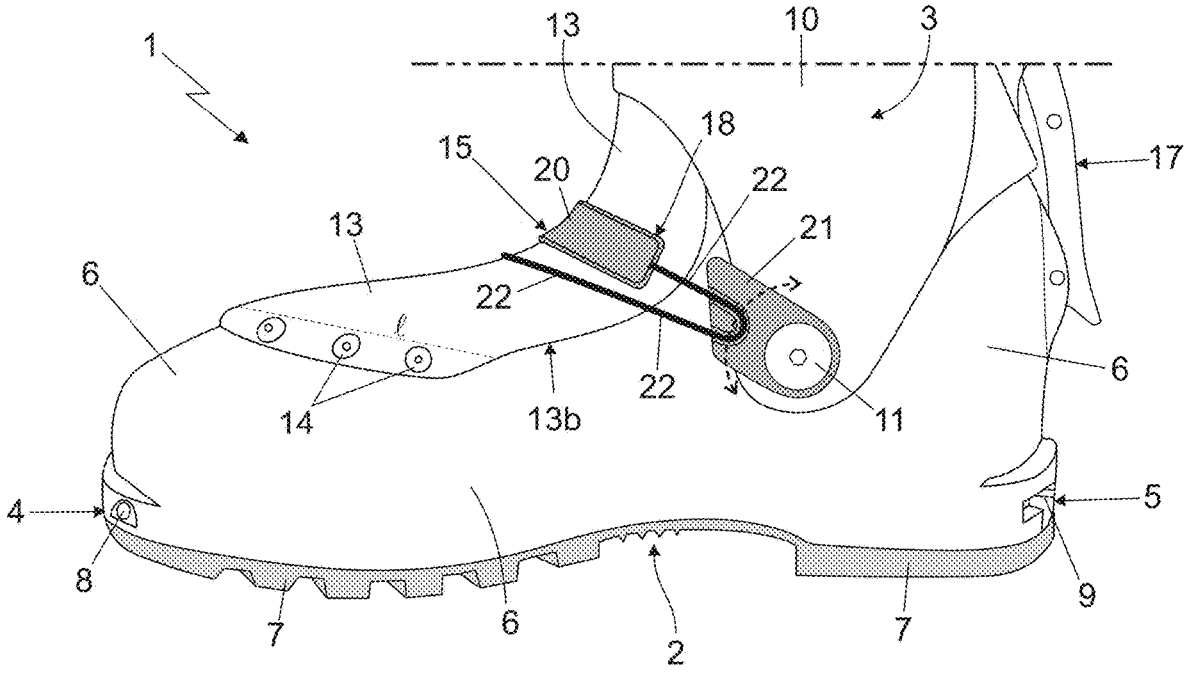
FIG. 2 is a side view of the ski boot illustrated in FIG. 1, with parts removed for clarity's sake.

With reference to FIGS. 1 and 2, reference number 1 denotes, as a whole, a ski boot that can be advantageously used for practicing the ski mountaineering or Telemark.

The ski boot 1 firstly comprises: a substantially rigid foot-case 2, which is substantially shoe-shaped and is adapted to accommodate/contain the user's foot; and a substantially rigid cuff 3, which is shaped so as to surround the lower part of the user's leg and is pivotally joined to the foot-case 2 so as to be able to freely swing about a transversal rotation axis A that is locally substantially perpendicular to the vertical midplane of the ski boot, and preferably also substantially coincides with the articulation axis of the user's ankle.

Preferably, the foot-case 2 moreover has the lower part specifically structured/shaped for being able to connect/couple in a rigid and stable, though easily releasable manner, to a ski binding device of known type (not shown), which in turn is adapted to be fixed in rigid manner to the back of a generic downhill ski or similar equipment.

More specifically, the lower part of foot-case 2 is preferably provided with a front tip 4 and with a rear heel 5.

The front tip 4 is preferably structured so as to connect/couple in a stable, though easily releasable manner, to the toe-piece (not shown) of a ski binding device which, in turn, is stably fixed to the back of a generic downhill ski or the like. Whereas, the rear heel 5 is preferably structured so as to connect/couple in a stable, though easily releasable manner, to the heel-piece (not shown) of a ski binding device which, in turn, is stably fixed to the back of a generic downhill ski or the like.

Still more specifically, the front tip 4 of foot-case 2 is preferably structured so as to connect/couple in known manner to the tip of a mountaineering ski binding device; whereas, the rear heel 5 of the foot-case 2 is preferably structured so as to be able to connect/couple in a known manner to the heel-piece of the same mountaineering ski binding device.

Preferably, the lower part of the foot-case 2 furthermore has a treaded profile so as to grip on snow and/or ice, and thus enable the user to walk on snow and ice in relative safety.

More specifically, with reference to FIGS. 1 and 2, the foot-case 2 preferably comprises: a substantially rigid shell 6 with a substantially oblong basin shape, which is preferably made of plastic and/or composite material, and is shaped so as to accommodate/contain the user's foot, preferably roughly up to the height of the ankle; and optionally a sole 7 preferably with treaded profile, which is preferably made of vulcanized rubber or other elastomeric material with high friction coefficient, and is firmly fixed to the bottom wall of shell 6 preferably by gluing.

In the example shown, in particular, the shell 6 is preferably made of PEBAX (polyester-amide), Nylon (polyamide) or other similar plastic polymer.

Clearly, shell 6 could also be made of a composite material preferably made up of one or more superimposed layers of carbon fibres and/or glass fibres and/or aramid fibres, suitably interweaved and/or superimposed on one another and embedded in a matrix of epoxy, phenolic or polyester resin preferably of thermosetting type.

In other words, the foot-case 2 is preferably mainly made of plastic and/or composite material.

With reference to FIGS. 1, 2, 3 and 4, in addition the foot-case 2 preferably also comprises: a rigid front insert 8, preferably made of metallic material, which is stably embedded/incorporated in the bottom wall of shell 6 in proximity of the tip 4 of foot-case 2, and is structured so as to connect/couple in known manner to the toe-piece (not shown) of the mountaineering ski binding device; and optionally also a rigid rear insert 9, preferably made of metallic material, which is instead embedded in shell 6 at the heel 5, and is structured so as to connect/couple in known manner to the heel-piece (not shown) of the same mountaineering ski binding device.

More specifically the rigid insert 8 has a plate-like structure and is dimensioned so as to surface/emerge outside of shell 6, on opposite sides of the front tip 4 of the foot-case, preferably in a substantially specular position with respect to the midplane of the ski boot, so that the two surfacing ends of the rigid insert 8 can connect in axially rotatable manner to the toe-piece of the mountaineering ski binding device.

With reference to FIGS. 1 and 2, the cuff 3 on the other hand preferably comprises a substantially rigid shell 10 preferably made of plastic and/or composite material, which is preferably substantially C-bent so as to cover the rear part of the user's leg, from the ankle substantially up to the height of the calf, and is moreover provided with two oblong and protruding lateral wings or flaps which extend forward on opposite sides of the midplane of the ski boot, so as to embrace from behind the user's leg roughly at the height of the calf, and then preferably superimpose one another at the front part of the leg, forming a tubular structure that surrounds the user's leg at the height of the calf.

Therefore, also the cuff 3 is preferably mainly made of plastic and/or composite material.

The cuff 3, in addition, is preferably fixed in free rotatable manner on the upper part of foot-case 2, or rather of shell 6, by means of two connecting hinges 11 preferably made of metallic material, which are located on the inner and outer lateral sides of the foot-case 2 and of the cuff 3, aligned along the transversal axis A, so as to allow the cuff 3 to freely swing forward and backward on the foot-case 2, while remaining always on a reference plane orthogonal to the transversal axis A and substantially coinciding with the midplane of the ski boot.

With reference to FIG. 1, in addition the ski boot 1 preferably also comprises an inner-boot 12 with a thermal-insulating structure, which is located inside the foot-case 2 and preferably also the cuff 3, and is shaped so as to accommodate and protect the user's foot and preferably also the lower part of the user's leg. Moreover the thermal-insulating inner-boot 12 is preferably provided with a soft and deformable internal lining, and is preferably inserted in manually-removable manner inside the foot-case 2 and preferably also the cuff 3.

The thermal-insulating inner-boot 12 minimises the heat losses towards the outside and prevents the user's foot and the user's leg from entering in direct contact with the foot-case 2 and/or the cuff 3.

More specifically, the thermal-insulating inner-boot 12 is preferably shaped substantially like a boot, and is dimensioned so as to accommodate and protect the user's foot and the lower part of the user's leg preferably roughly up to the top of the cuff 3. Preferably the inner-boot 12 furthermore has a structure of thermo-formable type.

With reference to FIGS. 1, 2, 3 and 4, in addition the ski boot 1 also comprises an oblong and flattened protective tongue 13, which is adapted to close the upper part of the foot-case 2, or rather the upper part of shell 6, so as to prevent snow and ice from penetrating inside the ski boot.

More specifically, the protective tongue 13 has a rigid or semi-rigid structure and is adapted to substantially entirely cover a large longitudinal slit (not visible in the figures), which preferably extends in a substantially sagittal direction along the upper part of the foot-case 2, or rather of the shell 6, while remaining over the user's instep and substantially astride of the midplane of the ski boot.

The protective tongue 13, in addition, is preferably separate and distinct from the foot-case 2, or rather from the shell 6, and is arranged resting on the upper part of the foot-case 2, or rather on the upper part of shell 6, substantially astride of the midplane of the ski boot.

Therefore, the protective tongue 13 extends in a substantially sagittal direction (i.e. parallel to the midplane of the ski boot), flush to the upper part of the foot-case 2, or rather to the upper part of shell 6, so that its two longitudinal edges, hereafter indicated by reference number 13*a* and 13*b*, are arranged resting on the foot-case 2, on opposite sides of the longitudinal slit of the foot-case 2 and of the midplane of the ski boot.

More specifically, the longitudinal edge 13*a* of protective tongue 13 is adjacent and adapted to rest on the outer side of the foot-case 2, whereas the longitudinal edge 13*b* is adjacent and adapted to rest on the inner side of the foot-case 2. Clearly, the longitudinal edges 13*a* and 13*b* are opposite one to the other.

Preferably, the protective tongue 13 is moreover made of plastic and/or composite material, and/or preferably has a monolithic structure.

Additionally, the protective tongue 13 is preferably stably fixed to the foot-case 2, or rather to the shell 6, with the capability of flipping forward, optionally also moving laterally toward the outer or inner side of the foot-case 2.

With reference to FIGS. 1, 2, 3 and 4, in the example shown, in particular, the oblong protective tongue 13 is preferably substantially L-bent, and is preferably structured so as to be able to substantially bend only at the elbow of the L.

Furthermore the protective tongue 13 is preferably arranged resting on the upper part of the foot-case 2, or rather on the upper part of shell 6, so that the front part of protective tongue 13 substantially entirely covers the longitudinal slit of the foot-case 2. Whereas, the rear part of protective tongue 13 extends cantilevered upward flush to the thermal-insulating inner-boot 12, preferably up to reach and optionally slip beneath the two oblong and protruding lateral wings or flaps of cuff 3, for covering and protecting the front part of the user's leg.

Additionally, the front end of tongue 13 is preferably firmly fixed to the upper-front part of the foot-case 2, or better of the shell 6, so that the protective tongue 13 can flip forward, preferably while remaining astride of a reference plane which is oblique (i.e. not perpendicular and not parallel) with respect to the midplane of the ski boot.

In the example shown, in particular, the tongue 13 is preferably fixed to the upper-front part of the foot-case 2, so as to be able of flipping forward moving laterally toward the inner side of the foot-case 2.

More specifically, with reference to FIGS. 1 and 2, in the example shown the front end of protective tongue 13 is preferably fixed in a rigid and stable manner to the foot-case 2, or rather to the shell 6, by means of a series of anchoring screws 14 located next to the front edge of the tongue 13. The tongue 13 furthermore has, behind the anchoring screws 14, a transversal bending line $\ell$ which is structured so as to allow the rest of the protective tongue 13 to freely rotate forward. Preferably the bending line $\ell$ moreover extends along the body of tongue 13 obliquely (i.e. not perpendicularly and not parallel) to the midplane of the ski boot, and the front edge of protective tongue 13 is preferably locally substantially parallel to the bending line $\ell$.

Clearly in a different embodiment, the front end of the protective tongue 13 may be firmly fixed to the upper-front part of the foot-case 2, or rather of the shell 6, via a normal hinge.

With reference to FIGS. 1 and 2, in addition the ski boot 1 is also provided with a foot-case closing mechanism 15 and with a cuff closing mechanism 16, preferably both manually operated.

The foot-case closing mechanism 15 is structured so as to selectively close/tighten the upper part of the foot-case 2 against the user's foot, in order to immobilise the user's foot inside the foot-case 2, or rather inside the inner-boot 12.

The cuff closing mechanism 16, in turn, is structured so as to selectively close/tighten the upper part of the cuff 3 against the user's leg, in order to immobilise the user's leg inside the cuff 3, or rather inside the inner-boot 12.

Preferably, the ski boot 1 is finally also provided with a manually-operated cuff locking device 17, which is structured so as to selectively lock the cuff 3 to the foot-case 2 in a predetermined downhill position, in which the cuff 3 is tilted forward with respect to the vertical of a given angle preferably ranging between 3° and 25°.

More specifically, the cuff locking device 17 is preferably fixed to the cuff 3 in the zone above the heel of the ski boot, substantially astride of the midplane of the ski boot, and is structured so as to, on choice and alternatively,

- connect the cuff 3 to the foot-case 2 so as to lock the cuff 3 in said downhill position; and
- completely unlock/release the cuff 3 from the foot-case 2 so as to allow the cuff 3 to freely swing forward and backward on the foot-case 2 about the transversal axis A, remaining on the midplane of the ski boot.

With reference to FIGS. 1, 2, 3 and 4, in turn, the foot-case closing mechanism 15 comprises: a transversal locking band 18, oblong in shaped and with a flexible and substantially inextensible structure, which extends transversally to the midplane of the ski boot, is arranged astride of the upper part of the foot-case 2, over and flush to the protective tongue 13, and has a first end firmly fixed to the inner side of foot-case 2, preferably at connecting hinge 11; and a manually-operated coupling assembly 19, which is adapted to connect the second end of the locking band 18 selectively and alternatively to the foot-case 2 or to the cuff 3, at the outer side of the foot-case 2 and preferably in proximity of connecting hinge 11.

Preferably, the coupling assembly 19 is moreover capable of tightening and keeping tightened the transversal locking band 18.

More specifically, the transversal locking band 18 preferably comprises: a flexible ribbon-like element 20 with a substantially inextensible structure, which is arranged astride of and flush to the protective tongue 13, more or less perpendicularly to the midplane of the ski boot; a return member 21, which is firmly fixed on the foot-case 2 and/or on the cuff 3, along the inner side of the foot-case 2 and in proximity of the connecting hinge 11; and a flexible cable 22 with a substantially inextensible structure, which is connected in rigid manner to the flexible ribbon-like element 20, extends obliquely along the inner side of the foot-case 2, up to reach and engage in a freely slidable manner the return member 21, and then rises obliquely along the inner side of the foot-case 2, towards the upper part of the foot-case 2, so as to go beyond the protective tongue 13 and reach the outer side of the foot-case 2.

In other words, the flexible cable 22 is U-bent at the return member 21.

Additionally, the return member 21 is preferably firmly fixed to the inner side of the foot-case 2, with the capability of freely swinging/oscillating about a reference axis locally substantially parallel to the transversal axis A, independently of the foot-case 2 and/or the cuff 3.

More specifically, with particular reference to FIG. 2, the return member 21 is preferably directly fixed to the inner connecting hinge 11.

In addition, the return member 21 is preferably fitted in axially rotatable manner directly on the inner connecting hinge 11, so as to be able to freely swing/oscillate about the transversal axis A.

With reference to FIG. 1, additionally the foot-case closing mechanism 15 preferably also comprises at least one auxiliary fairlead member 23, which is fixed in rigid manner or is anyway stably placed on the outer end of the foot-case 2, close to the outer longitudinal edge 13*a* of protective tongue 13, and the flexible cable 22 is adapted to engage in free slidable manner also the auxiliary fairlead member 23.

More specifically, the flexible cable 22 is preferably adapted to engage in freely slidable manner also the auxiliary fairlead member 23, before anchoring in rigid manner to the body of protective tongue 13, preferably close to the front end of the tongue.

In other words, the proximal end of flexible cable 22 is anchored in rigid manner to the flexible ribbon-like element 20, preferably so as to form an extension of the latter, whereas the distal end 22*a* of flexible cable 22 is anchored in rigid manner on the body of protective tongue 13, preferably in proximity of the front end of protective tongue 13.

Clearly, in a different embodiment, the distal end 22*a* of flexible cable 22 could also be anchored in rigid manner directly to the foot-case 2, or rather to the shell 6, preferably on the inner side of the same foot-case 2.

In the example shown, in particular, the flexible ribbon-like element 20 preferably has a monolithic structure and is preferably made of plastic material.

In other words, the flexible ribbon-like element 20 preferably basically consists of a flexible and substantially inextensible strip of plastic material.

The flexible cable 22, in turn, is preferably made of metallic material, whereas the return member 21 is preferably oblong in shape, and is preferably pivotally-joined with the head directly to the inner connecting hinge 11. Furthermore, the return member 21 is preferably made mainly of plastic material.

With reference to FIGS. 1, 2, 3 and 4, preferably the manually-operated coupling assembly 19 in turn comprises: a first component stably located on the foot-case 2, along the outer side of foot-case 2; a second component stably located on the cuff 3, at/flush to the outer side of foot-case 2; and a third component stably located on the transversal locking band 18, preferably at or in proximity of the second end of the same transversal locking band 18.

Furthermore, the third component is selectively connectable/couplable, on choice and alternatively, to the first or to the second component in a rigid and stable, though easily releasable manner, so as to anchor the locking band 18, on choice and alternatively, to the foot-case 2 or to the cuff 3, always along the outer side of the foot-case 2.

More specifically, the coupling assembly 19 preferably comprises: two stationary anchoring elements 24 and 25, which are located on the outer side of the foot-case 2, one integral with the foot-case 2 and the other with the cuff 3, preferably in proximity of the outer longitudinal edge 13*a* of protective tongue 13 and/or in proximity of connecting hinge 11; and a manually-operated coupling device 26, which is firmly and stably fixed to the transversal locking band 18, or rather to the flexible ribbon-like element 20, and is capable of connecting/coupling in a rigid and stable, though easily releasable manner, on choice and alternatively to any one of the two stationary anchoring elements 24 and 25, preferably while simultaneously tightening the locking band 18.

In other words, the coupling device 26 is adapted to couple the second end of the locking band 18 in a rigid and stable, though easily releasable manner, on choice and alternatively to the stationary anchoring element 24 and to the stationary anchoring element 25, preferably simultaneously tightening the locking band 18, or rather the flexible ribbon-like element 20 and the flexible cable 22.

More specifically, the anchoring element 24 is fixed in rigid and optionally also unmovable manner directly on the outer side of the foot-case 2, preferably in proximity of the outer longitudinal edge 13*a* of protective tongue 13 and/or in proximity of outer connecting hinge 11. The anchoring element 25, in turn, is fixed in a rigid and optionally also unmovable manner to the part of cuff 3 that superimposes the outer side of foot-case 2, preferably in proximity of the outer longitudinal edge 13*a* of protective tongue 13 and/or in proximity of the outer connecting hinge 11.

Additionally, the anchoring element 25 is preferably raised with respect to the anchoring element 24. In other words, the anchoring element 25 is located at a height from the sole 7 or from the ground greater than the anchoring element 24.

Figure 3:
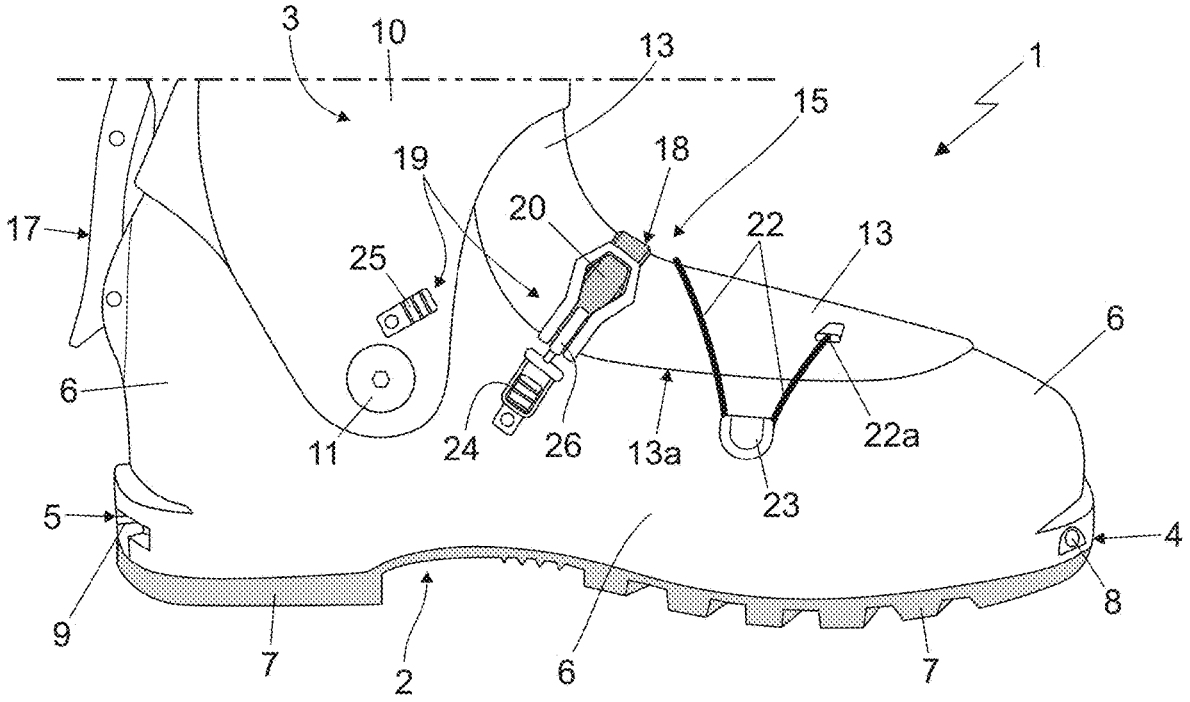
FIG. 3 is a side view of the ski boot illustrated in FIGS. 1 and 2, in a first operating configuration.
Figure 4:
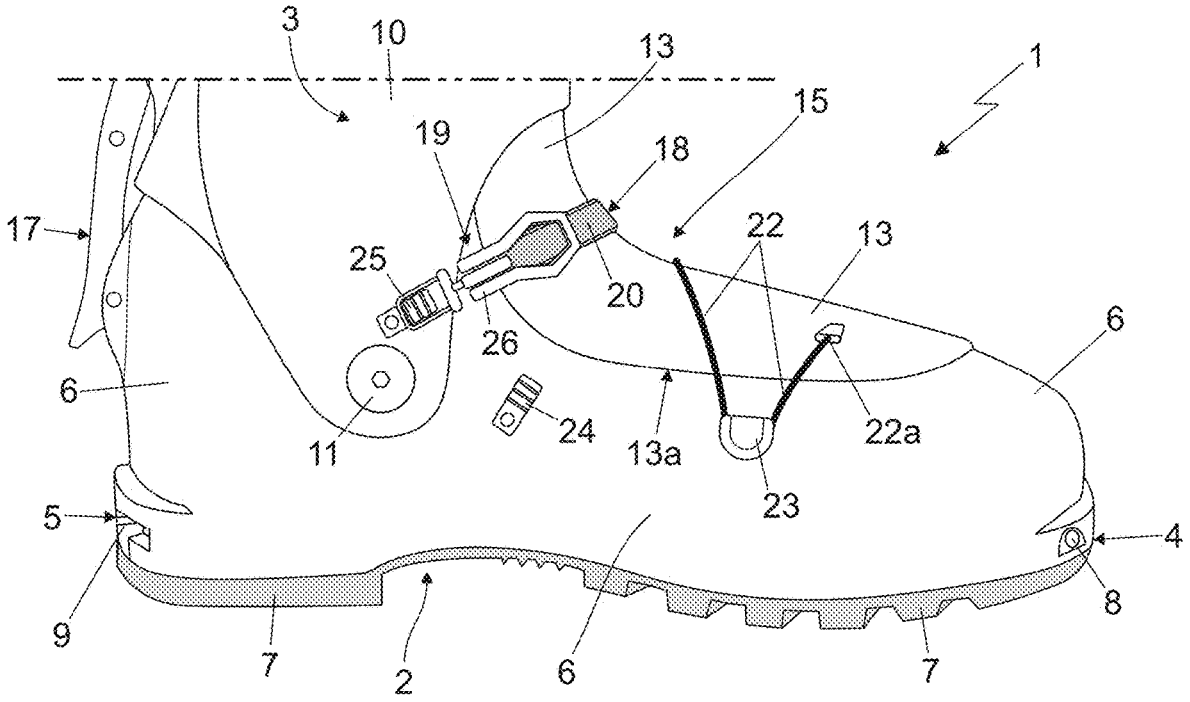
FIG. 4 is a side view of the ski boot illustrated in FIGS. 1 and 2, in a second operating configuration.

With reference to FIGS. 1, 3, and 4, preferably the anchoring elements 24 and 25 are moreover two plate-like racks, which are preferably made of metallic material and are fixed in rigid manner one onto the foot-case 2 and the other onto the cuff 3.

The coupling device 26, in turn, is preferably located on the distal end of the transversal locking band 18, or rather on the distal end of the flexible ribbon-like element 20, and is preferably consists of a traditional manually-operated lever closing buckle, which is suitably structured/dimensioned to couple to any one of the two plate-like racks.

The plate-like racks and the lever closing buckles are components already widely known and used in the ski boot filed and thus won't be further described.

With reference to FIG. 1, on the other hand, the cuff closing mechanism 16 preferably comprises: at least one manually-operated lever closing buckle 28, which is located astride of the two oblong and opposite, lateral wings or flaps of cuff 3, so as to be able to selectively pull one towards the other the two wings or flaps of cuff 3, in order to tighten the upper part of the cuff 3 against the user's leg; and optionally also an auxiliary tightening belt 29 with Velcro closure, which is looped around the top of the cuff 3 so as to selectively close/tighten the top of cuff 3 against the calf of the user's leg.

General operation of ski boot 1 is easily inferable from what described above, and does not require further explanations.

As regards instead the operation of the foot-case closing mechanism 15, when the coupling assembly 19 connects the transversal locking band 18 to the foot-case 2 (i.e. when the coupling device 26 couples to the stationary anchoring element 24), the foot-case closing mechanism 15 operates as a traditional foot-case closing mechanism and is capable of tightening the upper part of foot-case 2 against the user's foot, locking it inside the ski boot.

When instead the coupling assembly 19 connects the transversal locking band 18 to the cuff 3 (i.e. when the coupling device 26 couples to the stationary anchoring element 25), the foot-case closing mechanism 15 succeeds in locking/immobilising the user's ankle, and additionally aids the cuff locking device 17 to keep the cuff 3 still/stationary in the downhill position.

Consequently, the mountaineering skier can, in any moment, choose the configuration of the foot-case closing mechanism 15 that he/she deems the most appropriate.

More specifically, the mountaineering skier will anchor the transversal locking band 18 to the foot-case 2 when going up along the snowy slope, and will instead anchor the transversal locking band 18 to the cuff 3 when going down, thus increasing the overall rigidity of the ski boot 1.

The advantages connected to the new foot-case closing mechanism 15 are remarkable and evident.

The foot-case closing mechanism 15 is capable of adapting its tightening onto the foot-case 2 at the use conditions of the ski boot 1, with the enormous advantages that this entails during the practicing of mountaineering ski.

Additionally, the foot-case closing mechanism 15 allows to eliminate, from the inner side of the foot-case 2, any protruding metallic element that may, during use, damage the inner side of the other ski boot.

Last, but not least, the foot-case closing mechanism 15 is very simple to operate, with the functional advantages that this entails.

It is finally clear that modifications and variations may be made to the above-described ski boot 1 and to the foot-case closing mechanism 15 without however departing from the scope of the present invention.

For example, the protective tongue 13 may be made in a single block with the foot-case 2, or rather with the shell 6, and cover the longitudinal slit of the foot-case 2 in overlap configuration.

In other words, one side of the oblong protective tongue 13 is seamlessly joined/merged to the foot-case 2, or rather to the upper part of shell 6, on the side of the longitudinal slit of the foot-case 2, whereas the rest of the protective tongue 13 extends over the longitudinal slit of the foot-case 2, and overlaps the foot-case 2, or rather the upper part of shell 6, on the opposite side of the same longitudinal slit.

The protective tongue 13 is thus provided only with the outer longitudinal edge 13*a*.

In an not-shown embodiment variation, furthermore, the return member 21 may be located on the outer side of the foot-case 2, preferably at connecting hinge 11, whereas the two stationary anchoring elements 24 and 25 are located on the inner side of foot-case 2, one integral with the foot-case 2 and the other integral with the cuff 3, preferably in proximity of the inner longitudinal edge 13*b* of protective tongue 13 and/or in proximity of the inner connecting hinge 11.

Figure 5:
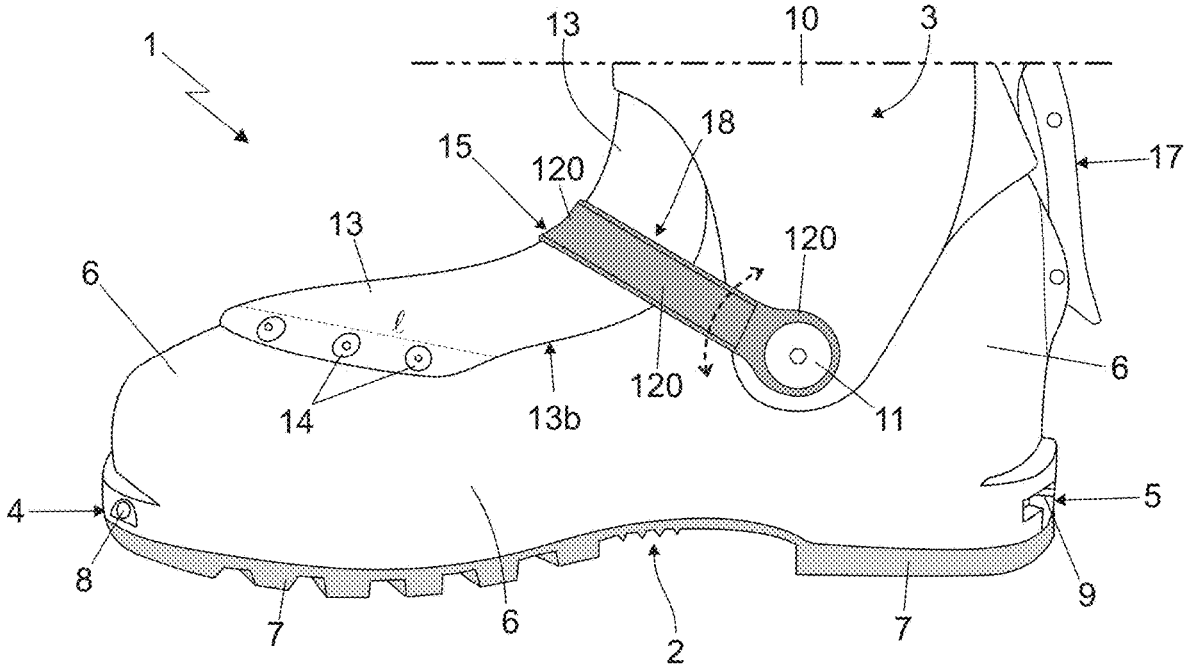
FIG. 5 is a side view of a first alternative embodiment of the ski boot illustrated in the preceding figures, with parts removed for clarity's sake.

According to the embodiment variation illustrated in FIG. 5, on the other hand, the transversal locking band 18 lacks the return member 21 and of the flexible cable 22. The flexible ribbon-like element 20, in turn, is replaced by a second flexible ribbon-like element 120 with a substantially inextensible structure, which preferably has a monolithic structure, and has the proximal end firmly fixed to the foot-case 2 and/or to the cuff 3, along the inner side of foot-case 2 and in proximity of connecting hinge 11.

Preferably, the proximal end of the flexible ribbon-like element 120 is furthermore fixed to the foot-case 2 and/or to the cuff 3, along the inner side of foot-case 2, with the capability of freely swinging/oscillating about a reference axis locally substantially parallel to the transversal axis A, independently of the foot-case 2 and/or of the cuff 3.

More specifically, the proximal end of the flexible ribbon-like element 120 is preferably fixed directly to the inner connecting hinge 11, with the capability of freely swinging/oscillating about the transversal axis A.

In other words, the flexible ribbon-like element 120 is preferably pivotally joined with the had directly to the inner connecting hinge 11, so as to be able to swing/oscillate about the transversal axis A.

Clearly, also in this variation embodiment the coupling device 26 of coupling assembly 19, i.e. the lever closing buckle, is firmly fixed to the distal end of the flexible ribbon-like element 120.

Figure 6:
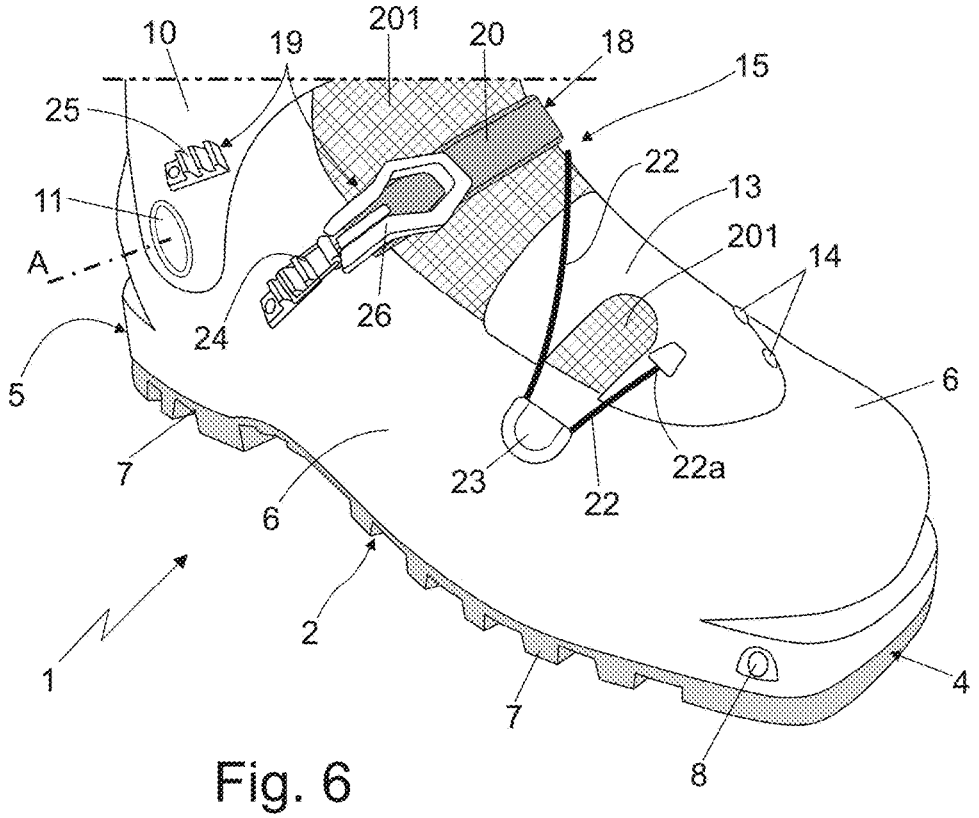

According to the embodiment variation illustrated in FIG. 6, instead, the longitudinal slit of foot-case 2, or rather of shell 6, is closed, preferably watertight, by a gaiter 201 made of fabric, preferably of waterproof type, or other flexible sheet material. In this variation, the protective tongue 13, if present, is preferably arranged resting on the upper part of the foot-case 2, or rather on the upper part of shell 6, over the gaiter 201.

Additionally, the protective tongue 13 is preferably dimensioned so as to cover only the front part of gaiter 201, and thus of the longitudinal slit of foot-case 2, preferably up to arrive next to the distal end of the transversal locking band 18, or rather of the flexible ribbon-like element 20.

Preferably, in this embodiment the front end of protective tongue 13 is furthermore firmly fixed to the upper-front part of the foot-case 2, or rather of shell 6, without the capability of flipping forward more or less obliquely to the midplane of the ski boot.

More specifically, in this embodiment the protective tongue 13 is preferably substantially triangular in shape. Preferably, the protective tongue 13 is finally provided with one or more lightening through openings or slits.

Moreover, in this embodiment the transversal locking band 18, or rather the flexible ribbon-like element 20, is preferably dimensioned to arrange itself astride of and flush to the gaiter 201, with the two ends resting on/flush to the inner side and the outer side of the foot-case 2, respectively.

Also in this embodiment the anchoring elements 24 and 25 are permanently located one on the foot-case 2 and the other on the cuff 3, in proximity of the edge of the gaiter 201 and/or in proximity of connecting hinge 11. The coupling device 26, in turn, is preferably firmly and stably fixed to the end of the transversal locking band 18, or rather to the end of the flexible ribbon-like element 20, and is capable of connecting/coupling in a rigid and stable, though releasable manner, on choice and alternatively to any one of the two stationary anchoring elements 24 and 25.

The flexible cable 22 in this case extends flush to the gaiter 201 before reaching the fairlead member 23.

Figure 7:
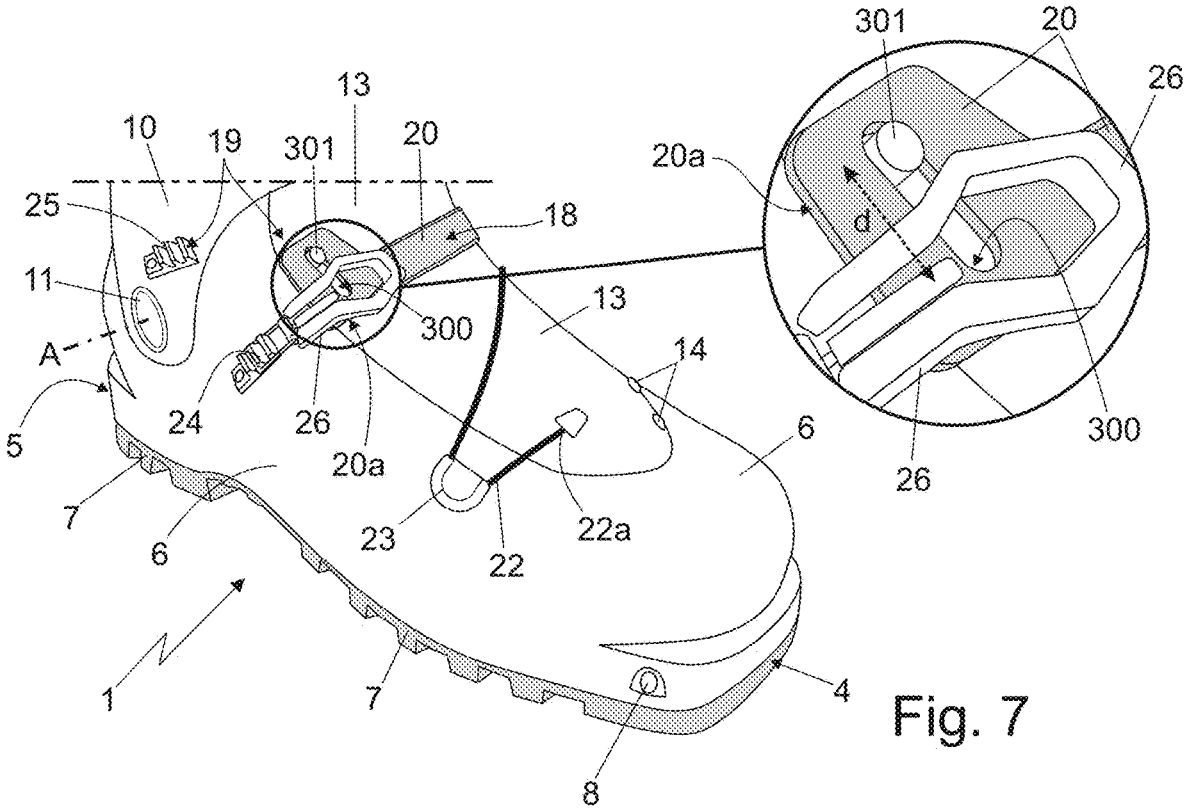
FIG. 7 is a perspective view of a the lower part of a third alternative embodiment of the ski boot illustrated in the preceding figures, with parts removed for clarity's sake.

With reference to FIG. 7, in a more sophisticated embodiment of the foot-case closing mechanism 15, the second end of locking band 18, or rather the distal end 20*a* of the flexible ribbon-like element 20, is preferably arranged resting on the protective tongue 13, and is locally stably fixed to the same protective tongue 13 so as to be able to freely slide on the surface of the tongue, in a direction d transversal to the locking band 18.

More specifically, the second end of the transversal locking band 18, or rather the distal end 20*a* of the flexible ribbon-like element 20, is preferably fixed to the protective tongue 13 via a slidable mechanical connection, which allows said second end to freely move on the protective tongue 13 almost only in a direction d that is flush to the surface of protective tongue 13 and is preferably also locally substantially parallel to the midplane of the ski boot and/or locally substantially perpendicular to the same locking band 18.

Still more specifically, the second end of locking band 18, or rather the distal end 20*a* of the flexible ribbon-like element 20, preferably has a plate-like structure.

Additionally, the locking band 18 preferably has, on the second end, a large oblong-shaped through slot 300, which extends transversally to the locking band 18, or rather to the longitudinal axis of the flexible ribbon-like element 20, and is stably engaged in free slidable manner by a protruding pin 301 which in turn juts out cantilevered from, and is rigidly integral with, the protective tongue 13.

The through slot 300 is preferably also substantially rectilinear and/or parallel to the direction d. Clearly, the through slot 300 could also be arched.

In the example shown, in particular, the through slot 300 is preferably substantially straight, and is preferably substantially perpendicular to the flexible ribbon-like element 20, or rather to the longitudinal axis of the flexible ribbon-like element 20.

The protruding pin 301, in turn, preferably has a mushroom structure so as to retain the distal end 20*a* of the flexible ribbon-like element 20 stably in abutment against the surface of the oblong protective tongue 13, and is preferably made in a one piece with protective tongue 13.

Preferably, the protruding pin 301 is located in proximity of a first end of through slot 300 when the coupling device 26 couples to the stationary anchoring element 24, and is located in proximity of the second end of the through slot 300 when the coupling device 26 couples to the stationary anchoring element 25.

Clearly, also in this embodiment, the transversal locking band 18 may lack the return member 21 and the flexible cable 22, whereas the flexible ribbon-like element 20 would be replaced by a second flexible ribbon-like element with a substantially inextensible structure, which has the proximal end firmly fixed to the foot-case 2 and/or to the cuff 3, along the inner side of the foot-case 2 and advantageously at the connecting hinge 11.

Finally, in a different embodiment of coupling assembly 19, the two stationary anchoring elements 24 and 25 may be replaced by two manually-operated lever closing buckles, fixed one to the foot-case 2 and the other to the cuff 3, whereas the coupling device 26 may be replaced by a plate-like rack or by a retched tongue, which is firmly fixed to or incorporated in the distal end of the locking band 18, or rather of the flexible ribbon-like element 20, and is capable of connecting/coupling on choice and alternatively to any one of the two lever closing buckles.

The invention claimed is:

1. A ski boot comprising:

a substantially rigid foot-case which is adapted to accommodate a user's foot and has a lower part structured to couple with a ski binding device;

a substantially rigid cuff which is adapted to surround a lower part of the user's leg and is pivotally joined to the foot-case so as to be able to rotate about a transversal axis substantially perpendicular to a midplane of the ski boot;

a protective tongue and/or gaiter that closes an upper part of the foot-case; and foot-case closing means adapted to selectively close/tighten the foot-case on the user's foot;

wherein the foot-case closing means comprise:

an oblong, transversal locking band with a flexible and substantially inextensible structure, which extends transversally to the midplane of the ski boot, astride of and flush to the protective tongue and/or gaiter, and has a first end stably fixed to a first lateral side of the foot-case; and a manually-operated coupling assembly which is adapted to connect a second end of said transversal locking band selectively and alternatively to either one of the foot-case and the cuff, at a second lateral side of the foot-case opposite to said first lateral side;

wherein the coupling assembly is adapted to tighten and keep tightened the transversal locking band; and wherein the coupling assembly comprises:

a first stationary anchoring element located on the foot-case, along said second lateral side of the foot-case;

a second stationary anchoring element located on the cuff, along said second lateral side of the foot-case; and a manually-operated coupling device, which is firmly and stably fixed to said transversal locking band and is adapted to couple in a rigid, stable, and releasable manner, on choice and alternatively to said first or to said second stationary anchoring element.

2. The ski boot according to claim 1, wherein the coupling device is adapted to tighten the transversal locking band.

3. The ski boot according to claim 1, wherein the first stationary anchoring element comprises a first rack; wherein the second stationary anchoring element comprises a second rack; and wherein the coupling device comprises a lever closing buckle adapted to couple to any one of said first and second racks.

4. The ski boot according to claim 1, wherein the transversal locking band is fixed to said first lateral side of the foot-case, at a hinge connecting the cuff to the foot-case.

5. The ski boot according to claim 1, wherein the transversal locking band comprises: a flexible ribbon shaped element arranged astride of and flush to said protective tongue and/or gaiter; a return member firmly fixed on the foot-case and/or on the cuff, along said first lateral side of the foot-case; and a flexible cable which is connected in a rigid manner to the flexible ribbon shaped element, extends obliquely along said first lateral side of the foot-case to engage said return member in a slidable manner, and then rises obliquely along said first lateral side of the foot-case, towards the upper part of the foot-case so as to go beyond the protective tongue and/or gaiter and reach said second lateral side of the foot-case.

6. The ski boot according to claim 5, wherein a distal end of the flexible cable is anchored in a rigid manner to a body of the foot-case or to a body of the protective tongue.

7. The ski boot according to claim 5, wherein said return member is fixed directly on a hinge connecting the cuff to the foot-case.

8. The ski boot according to claim 5, wherein said return member is fixed to said first lateral side of the foot-case with the capability of swinging about a reference axis substantially parallel to said transversal axis.

9. The ski boot according to claim 5, wherein the foot-case closing means additionally comprise at least one auxiliary fairlead member which is stably located on said second lateral side of the foot-case, adjacent to said protective tongue and/or gaiter, and the flexible cable is adapted to slidably engage said auxiliary fairlead member.

10. The ski boot according to claim 1, wherein the transversal locking band comprises: a flexible ribbon shaped element which is arranged astride of and flush to said protective tongue and/or gaiter, and has a proximal end firmly fixed to the foot-case and/or to the cuff, along said first lateral side of the foot-case.

11. The ski boot according to claim 10, wherein the proximal end of said flexible ribbon shaped element is fixed directly to a hinge connecting the cuff to the foot-case.

12. The ski boot according to claim 10, wherein the proximal end of said flexible ribbon shaped element is fixed on said first lateral side of the foot-case with the capability of swinging about a reference axis substantially parallel to said transversal axis.

13. The ski boot according to claim 1, wherein said first lateral side of the foot-case is an inner side of the foot-case, and said second lateral side of the foot-case is an outer side of the foot-case.

14. The ski boot according to claim 1, wherein the protective tongue is separate from the foot-case and has a front end firmly fixed to an upper-front part of the foot-case, with the capability of flipping forward.

15. A ski boot comprising:

a substantially rigid foot-case which is adapted to accommodate a user's foot and has a lower part structured to couple with a ski binding device;

a substantially rigid cuff which is adapted to surround a lower part of the user's leg and is pivotally joined to the foot-case so as to be able to rotate about a transversal axis substantially perpendicular to a midplane of the ski boot;

a protective tongue and/or gaiter that closes an upper part of the foot-case; and foot-case closing means adapted to selectively close/tighten the foot-case on the user's foot;

wherein the foot-case closing means comprise:

an oblong, transversal locking band with a flexible and substantially inextensible structure, which extends transversally to the midplane of the ski boot, astride of and flush to the protective tongue and/or gaiter, and has a first end stably fixed to a first lateral side of the foot-case; and a manually-operated coupling assembly which is adapted to connect a second end of said transversal locking band selectively and alternatively to either one of the foot-case and the cuff, at a second lateral side of the foot-case opposite to said first lateral side; and wherein the transversal locking band is fixed to said first lateral side of the foot-case at a hinge connecting the cuff to the foot-case.

16. A ski boot comprising:

a substantially rigid foot-case which is adapted to accommodate a user's foot and has a lower part structured to couple with a ski binding device;

a substantially rigid cuff which is adapted to surround a lower part of the user's leg and is pivotally joined to the foot-case so as to be able to rotate about a transversal axis substantially perpendicular to a midplane of the ski boot;

a protective tongue and/or gaiter that closes an upper part of the foot-case; and foot-case closing means adapted to selectively close/tighten the foot-case on the user's foot;

wherein the foot-case closing means comprise:

an oblong, transversal locking band with a flexible and substantially inextensible structure, which extends transversally to the midplane of the ski boot, astride of and flush to the protective tongue and/or gaiter, and has a first end stably fixed to a first lateral side of the foot-case; and a manually-operated coupling assembly which is adapted to connect a second end of said transversal locking band selectively and alternatively to either one of the foot-case and the cuff, at a second lateral side of the foot-case opposite to said first lateral side; and wherein the transversal locking band comprises: a flexible ribbon shaped element which is arranged astride of and flush to said protective tongue and/or gaiter, and has a proximal end firmly fixed to the foot-case and/or to the cuff, along said first lateral side of the foot-case.

* * * * *